United States Patent [19]

Marin

[11] 4,293,750

[45] Oct. 6, 1981

[54] ELECTRIC GAS BLAST CIRCUIT BREAKER

[75] Inventor: Heiner Marin, Berlin, Fed. Rep. of Germany

[73] Assignee: Siemens Aktiengesellschaft, Berlin and Munich, Fed. Rep. of Germany

[21] Appl. No.: 123,553

[22] Filed: Feb. 22, 1980

[30] Foreign Application Priority Data

Feb. 27, 1979 [DE] Fed. Rep. of Germany ..... 2907691

[51] Int. Cl.[3] ..... H01H 33/88

[52] U.S. Cl. ..... 200/148 A

[58] Field of Search ..... 200/148 A, 150 G, 148 G, 200/148 B

[56] References Cited

U.S. PATENT DOCUMENTS

| | | | |
|---|---|---|---|
| 3,941,962 | 3/1976 | Thaler | 200/148 A |
| 3,975,602 | 8/1976 | Hertz et al. | 200/148 A |
| 4,080,521 | 3/1978 | Goedecke et al. | 200/148 G |
| 4,139,751 | 2/1979 | Rostron et al. | 200/148 A |

FOREIGN PATENT DOCUMENTS

| | | | |
|---|---|---|---|
| 2541851 | 3/1977 | Fed. Rep. of Germany | 200/148 A |
| 2741357 | 3/1979 | Fed. Rep. of Germany | 200/148 A |
| 1510399 | 5/1978 | United Kingdom | 200/148 A |

*Primary Examiner*—Robert S. Macon

*Attorney, Agent, or Firm*—Spellman, Joel and Pelton

[57] ABSTRACT

The circuit breaker contains a contact system and a blast device. The blast device produces a flow of quenching gas required for the quenching of the switch-off arc in the contact system. The blast device, which is assigned to the contact system, includes an annular piston and a movable cylinder. The piston is sealed via a first sealing ring against the cylinder and via a second sealing ring of different diameter against a movable cylindrical bridging element of the contact system.

The circuit breaker also contains a one-way-action valve which is closed in the compression phase and opened in the intake phase. The valve is formed by the two sealing rings which are located in the same plane. They are arranged with axial play in annular grooves which are formed in the piston in flow paths for the quenching gas. Between the sealing rings is arranged at least one spacer element. The rings are supported in a way so that they are movable transversely to the main axis of the piston.

8 Claims, 2 Drawing Figures

ELECTRIC GAS BLAST CIRCUIT BREAKER

FIELD OF THE INVENTION

This invention relates to an electric compressed-gas or gas blast circuit breaker.

BACKGROUND OF THE INVENTION

From the U.S. Pat. No. 4,139,751 is known a compressed-gas circuit breaker which contains a contact system and a blast device which is assigned to the contact system. The blast device has a fixed, ring shaped piston and a movable cylinder. The piston is sealed via a first sealing ring against the cylinder and via a second sealing ring against a movable cylindrical switching element of the contact system. The circuit breaker further contains a non-return or one-way valve, which is closed in the compression phase and opened in the intake phase of the circuit breaker. In this circuit breaker the one-way valve is formed by apertures in the outer annular portion of the fixed piston which may be closed by spring-loaded combinations of annular rings and rods (see U.S. Pat. No. 4,139,751, FIG. 7). In the compression phase, the force of the valve springs is supported by the gas, and the apertures are kept closed. In the intake phase, the force of the valve springs is overcome, and the apertures are opened.

The British Pat. No. 1,510,399 discloses a compressed-gas circuit breaker which also contains a blast device having a fixed piston and a movable cylinder. The circuit breaker further contains two stationary contacts which are electrically connected with each other by a bridging switching element in the closing position. In this circuit breaker there are provided two sealing rings in the plane transverse to the axis of the piston. One of the sealing rings engages the blast cylinder, and the other sealing ring engages the movable cylindrical switching element of the contact system. In this circuit breaker, a one-way valve is not provided.

The German Offenlegengschrift No. 25 41 851 describes a feed or booster pump for application as a blast device for quenching gas in compressed-gas circuit breakers for high voltage. The pump contains a one-way valve that is formed by a piston ring. The piston ring is located in an annular groove which is arranged in the piston. The piston ring has some space and is spring biased in the axial direction of the piston. Under the effect of the springs, the piston ring closes openings in the piston which connect the pressure side with the vacuum side of the piston. Thereby, the cylinder surrounds the piston in a sealed, pressure-tight manner when the piston is moved in the direction of transportation of the pumped medium, whereas this pressure-tight seal is eliminated in the reverse direction.

SUMMARY OF THE INVENTION

1. OBJECTS OF THE INVENTION

It is an object of the invention to improve the one-way gas control valve in electric gas blast circuit breakers in order to obtain a simplified and space saving design.

It is another object of the invention to provide an electric gas blast circuit breaker in which radial forces exercised on the sealing rings of the annular piston are distributed uniformly during the operation of the blast device.

2. SUMMARY OF THE INVENTION

The above-noted objects, as well as other objects which will become apparent from the discussion that follows, are achieved, according to the present invention, by providing a gas blast circuit breaker of the type having an electric contact system with a movable cylindrical contact member and a gas arc quenching system, surrounding the electric contact system, with (1) annular piston, (2) a movable cylinder, (3) two sealing rings arranged, respectively, between the piston and the movable cylinder on one side, and between the piston and the cylindrical contact member on the other, and (4) a one-way valve for control of the quenching gas, which is closed during the compression phase and open during the intake phase of the circuit breaker. According to a first feature of the invention the sealing rings are disposed in a common plane in annular grooves of the piston and means are arranged between the two sealing rings for constraining the rings to be displaced jointly in the plane direction. According to a second feature of the invention the sealing rings are dimensioned so as to have axial play within their respective annular grooves and the piston includes flow paths to and from the grooves for the quenching gas so that the sealing rings themselves form the one-way valve.

With this design, according to the invention, the sealing rings form the movable valve members of the one-way valve. The sealing rings are also jointly movable with respect to the annular piston via spacer means disposed between these rings. Therefore, the sealing rings are supported without any forces acting radially, that is, transverse to the piston axis. This is particularly of advantage in in the embodiment of the gas blast circuit breaker which is known from German Offenlegungschrift No. 25 38 132. In this embodiment, one of two stationary contacts forms a stationary guide for the blast cylinder and the bridging switching or contact element. Since the annular piston, which is arranged between the bridging switching element and the blast cylinder, is also fixed, the feature of the common movability of both sealing rings in radial direction avoids a static over-determination of the guiding element.

By means of the common and movable support of the two sealing rings, which are forced away from each other in the radial direction by one or more spacer elements, a seal is provided, even if greater production tolerances with regard to the diameters of the various cylinders should occur. Furthermore, both sealing rings of the piston participate in forming the one-way valve. Therefore, a greater effective valve cross section will result in the small annular gap between the annular piston and blast cylinder on the one side, and between the annular piston and the bridging contact element on the other side. dr

BRIEF DESCRIPTION OF THE DRAWINGS

The foregoing and other objects, features and advantages of the invention will be apparent from the following more particular description of the preferred embodiment of the invention, as illustrated in the accompanying drawings.

In the drawings.

DESCRIPTION OF THE PREFERRED EMBODIMENTS OF THE INVENTION

Figure 1:
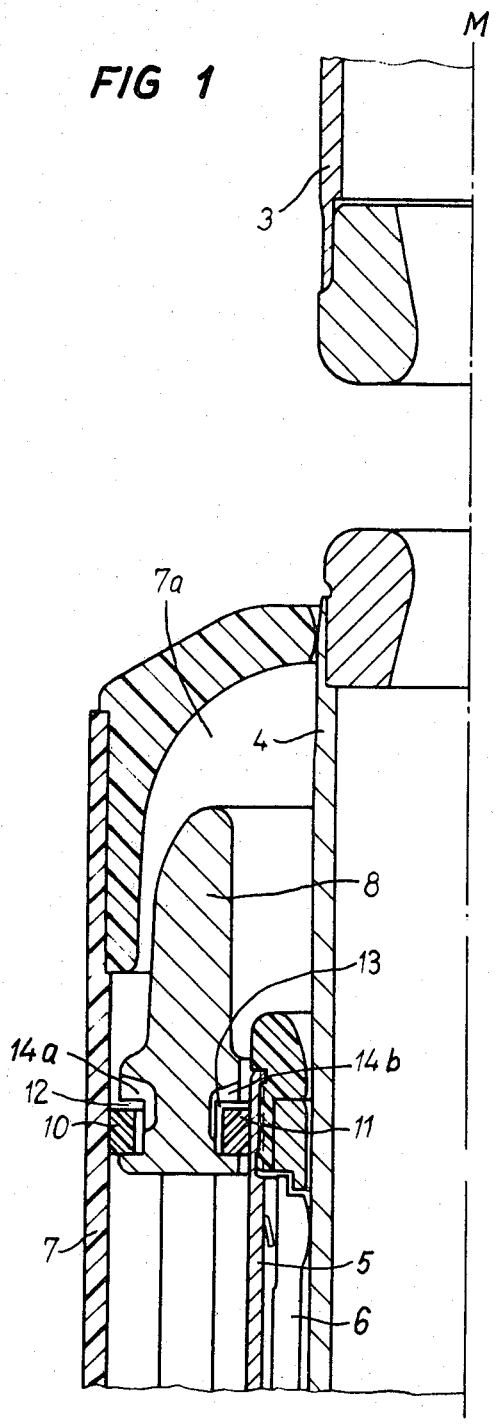
FIG. 1 schematically illustrates a fragmentary cross-sectional view of the left half of an electric compressed-gas power circuit breaker in an open position.
Figure 2:
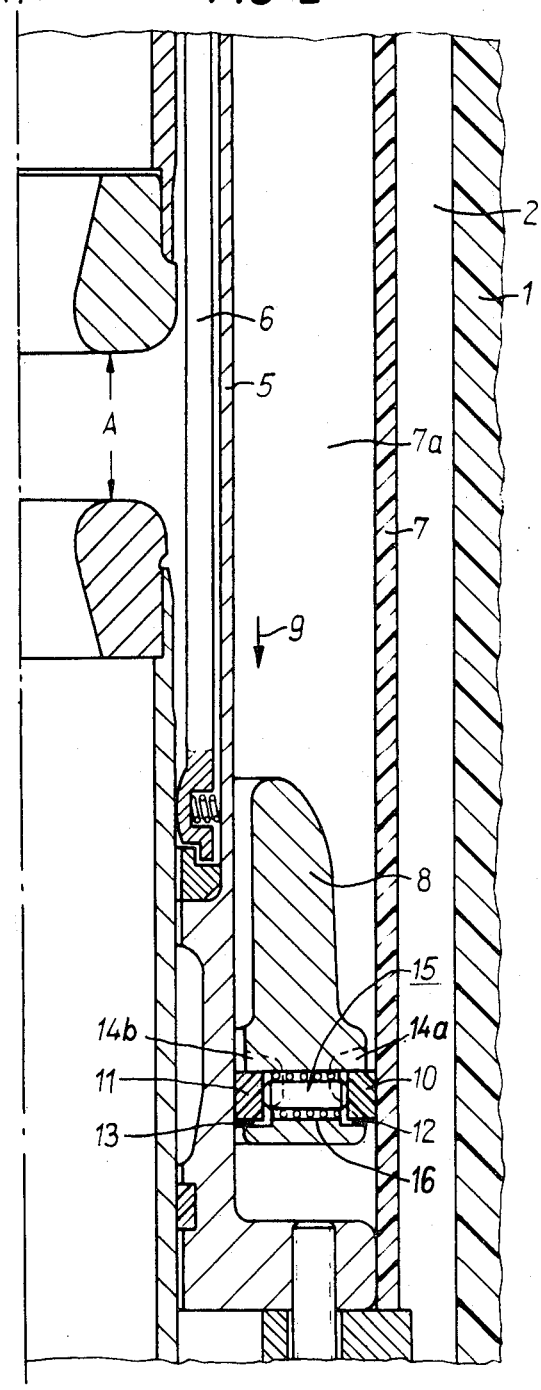
FIG. 2 schematically illustrates a fragmentary cross-sectional view of the right half of the circuit breaker of FIG. 1 in a closed position.

FIGS. 1 and 2 show an electric gas blast power circuit breaker of the blast piston type in partial view. For the sake of simplicity, only those parts of the circuit breaker necessary for an understanding of the invention are shown. For example, the drive and supporting insulators are not illustrated.

The circuit breaker includes a housing 1 (see FIG. 2), for example, of porcelain which defines a switching chamber 2 in which two hollow tubular contact pieces or contacts 3 and 4 are mounted. The contacts 3 and 4 are aligned along a central line M. The distance between their end faces is referred to as A. The switching chamber 2 is filled with a gas, such as sulfur hexafluoride (SF6), at a pressure of, e.g. 6 bar. The distance A between the end faces of the contacts 3 and 4 forms the disconnection space of the circuit breaker when it is in its open position.

In the closed position (see FIG. 2) the contacts 3 and 4 are electrically connected by a movable bridging switching element 5 of tubular shape. The bridging switching element 5 has a plurality of spring-loaded contact fingers 6 which are equally distributed around its circumference. The movable bridging switching element 5 is mechanically connected to a blast cylinder 7.

When the circuit breaker gets from its closed position (shown in FIG. 2) to its open position (shown in FIG. 1), the bridging switching element 5 together with the blast cylinder 7 move downward in the direction of the arrow 13. In the course of such a motion, the blast cylinder 7 is moved over a stationary piston 8 of ring shape. Thereby, the quenching and insulating medium present within the interior 7*a* of the blast cylinder 7, is compressed (compression phase). After separation of the contacts, the medium is effective for quenching the arc.

In its lower part, the piston 8 contains two annular grooves 12 and 13. The groove 12 is arranged in the outer surface and the groove 13 is arranged in the inner surface of the piston 8. Contained in these annular grooves 12 and 13 are sealing rings 10 and 11, respectively, which are located essentially in a common plane. Within the grooves 12 and 13, the sealing rings 10 and 11 are displaceable axially, that is in the direction of the central line M. For this purpose, the axial width of the sealing rings 10, 11 is somewhat smaller than the axial width of the grooves 12, 13.

The annular grooves 12, 13 are located in gas passageways or flow paths 14*a* and 14*b*, respectively, which connect the vacuum side with the pressure side of the piston 8 in the closed breaker position shown in FIG. 2. As can be seen from FIGS. 1 and 2, the flow paths 14*a* and 14*b* extend from the middle sections of the grooves 12 and 13, respectively, towards the upper part of the piston 8, that is towards the end face of the contact 4. In the open breaker position shown in FIG. 1, the flow paths 14*a* and 14*b* are blocked by the sealing rings 10 and 11, respectively. In this position, the sealing rings 10 and 11 seal with their lower surfaces the lower surfaces of the grooves 12 and 13, respectively.

The sealing rings 10, 11 are supported in such a way that they are jointly slideable transversely to the axis of the piston 8 (and therefore transversely to the central line M). For this purpose a spacing element, which is generally referred to as 15 in FIG. 2, is interposed between the sealing rings 10 and 11. The support of the sealing rings-spacing element combination 10, 11, 15 is also performed in such a way that there is no acting transverse force in this combination. The inner diameter of the outer sealing ring 10 is somewhat bigger than the diameter of the outer groove 12, and the outer diameter of the inner sealing ring is somewhat smaller than the diameter of the inner groove 13, to allow for such a transverse displacement.

As can be seen from FIG. 2, a connection channel 16 is provided between the annular grooves 12 and 13. The connection channel 16 is in the form of a transverse bore. A plurality of such connection channels 16 may be provided in the lower part of the piston 8. The connection channel 16 contains the spacing element 15. Within the connection channel 16, the spacing element 15 is arranged so that it can slide transversely to the central line M.

The spacing element 15 in FIG. 2 is a cylindrical helical spring which is slideably mounted on a cylindrical bolt or pin. However, it is not necessary to use such a combination of a spring and a pin as the spacing element 15. It is also possible to use either only a spring or only a pin as the spacing element 15 to keep the sealing rings 10 and 11 at a certain distance from each other. In the embodiment shown, the helical spring exercises some pressure on the sealing rings 10 and 11.

It should be noted again that all kinds of elements which may be used as spacing elements 15, should be mounted such as to be able to be displaced radially (transversely to the central line M) in the piston 8.

While the form of the electric gas blast circuit breaker herein described constitutes a preferred embodiment of the invention, it is to be understood that the invention is not limited to this precise form of assembly, and that a variety of changes may be made therein without departing from the scope of the invention.

What is claimed is:

1. In an electric gas blast circuit breaker comprising:

(a) an electric contact system having a movable cylindrical contact member; and (b) a gas arc quenching system surrounding the electric contact system, having:

(1) an annular piston;

(2) a movable cylinder;

(3) two sealing rings arranged, respectively between said piston and said movable cylinder on one side, and between said piston and said cylindrical contact member on the other side; and (4) a one-way valve for the control of quenching gas, which valve is closed during the compression phase and open during the intake phase of the circuit breaker;

the improvement wherein said sealing rings are disposed on a common plane in annular grooves of said piston; wherein means are arranged between said two sealing rings for constraining said rings to be displaced jointly in the direction of said plane; wherein said sealing rings are dimensioned to provide axial play within said grooves; and wherein said piston includes flow paths to and from said grooves for the quenching gas such that said sealing rings form said one-way valve.

2. In an electric compressed-gas circuit breaker, an annular piston which has a main piston axis and is slideably mounted between inner wall means adjacent to an inner surface of said piston and outer wall means adjacent to an outer surface of said piston, said piston comprising:

(a) an inner annular groove formed in the inner surface of said piston;

(b) an outer annular groove formed in the outer surface of said piston;

(c) an inner flow path for compressed gas extending across the inner groove along the inner surface of said piston;

(d) an outer flow path for compressed gas extending across the outer groove along the outer surface of said piston;

(e) an inner sealing ring arranged in said inner groove for sealingly sliding on said inner wall means, said inner sealing ring having some space within said inner groove in the direction of said piston axis and blocking the gas passage through said inner flow path when a relative motion occurs between said piston and said inner wall means in order to compress said gas, thereby forming a one-way valve for said gas;

(f) an outer sealing ring arranged in said outer groove for sealingly sliding on said outer wall means, said outer sealing ring having some space within said outer groove in the direction of said piston axis and blocking the gas passage through said outer flow path when a relative motion occurs between said piston and said outer wall means in order to compress said gas, thereby also forming a one-way valve for said gas; and (g) spacer means arranged between said sealing rings for allowing for a joint movement of said sealing rings transversely to said piston axis.

3. An electric compressed-gas blast circuit breaker comprising, in combination:

(a) a contact arrangement having two stationary mutually adjacent contact pieces and a cylindrical bridging switching element which is movable between closed and open positions for electrically bridging said contact pieces in the closed position and for electrically disconnecting said pieces in the open position whereby an arc develops when said bridging switching element is moved to the open position;

(b) compressed-gas blast means for blasting compressed gas into said arc during the movement of said bridging switching element to said open position, said blast means having:

(1) a movable blast cylinder; and (2) a stationary annular piston, said piston surrounding said bridging switching element and being surrounded by said movable cylinder in said closed position, said piston having a first annular groove in its outer surface and a second annular groove in its inner surface, further having a first sealing ring disposed in the first groove for sealing said piston against said cylinder and having a second sealing ring disposed in the second groove for sealing said piston against said switching element, said sealing rings being arranged in said grooves with some play in the axial direction of said piston, said piston further having flow paths for said quenching gas in said inner and outer surfaces, wherein said sealing rings form one-way valves in said grooves, and means for supporting said sealing rings for joint movement transversely to the axis of said piston.

4. The circuit breaker according to claim 3, wherein said means for supporting comprise at least one spacer element arranged between said sealing rings.

5. The circuit breaker according to claim 4, wherein said spacer element is arranged in a channel which connects said grooves.

6. The circuit breaker according to claim 5, wherein said spacer element comprises a spring which engages said sealing rings under pressure.

7. The circuit breaker according to claim 5, wherein said spacer element comprises a pin which engages said sealing rings and is movable in said channel transversely to said piston axis.

8. The circuit breaker according to claim 5, wherein said spacer element comprises a cylindrical bolt which is surrounded by a spring.

* * * * *